US007383948B1

(12) United States Patent
Richardson

(10) Patent No.: US 7,383,948 B1
(45) Date of Patent: Jun. 10, 2008

(54) PAINT BRUSH CLEANING ACCESSORY

(76) Inventor: Janice Richardson, 7708 Nalan Dr., Louisville, KY (US) 40219

( * ) Notice: Subject to any disclaimer, the term of this patent is extended or adjusted under 35 U.S.C. 154(b) by 0 days.

(21) Appl. No.: 09/955,778

(22) Filed: Sep. 18, 2001

(51) Int. Cl.
*A45D 44/18* (2006.01)

(52) U.S. Cl. ..... 206/15.3; 206/229; 206/209; 220/735

(58) Field of Classification Search ..... 206/361, 206/362, 362.1, 362.2, 362.3, 15.2, 15.3, 206/209, 229; 211/69, 66; 220/739, 736, 220/696, 697, 699
See application file for complete search history.

(56) References Cited

U.S. PATENT DOCUMENTS 2,533,355 A * 12/1950 Comfort ..... 131/260
2,952,364 A 9/1960 Jacobson
3,209,387 A * 10/1965 Lukesch ..... 206/15.2
3,905,476 A * 9/1975 Foreman ..... 141/390
3,918,582 A 11/1975 Wallace
4,533,044 A * 8/1985 Ban ..... 206/15.2
5,022,559 A * 6/1991 Condon ..... 15/104.94
5,097,967 A 3/1992 Sica
5,540,363 A 7/1996 Wilson
5,829,603 A 11/1998 Martineau
5,992,617 A * 11/1999 Couch et al. ..... 206/15.2
6,041,919 A * 3/2000 Adams ..... 206/15.2
6,135,279 A * 10/2000 Dryer ..... 206/15.2

* cited by examiner

*Primary Examiner*—Shian Luong

(57) ABSTRACT

A paint brush cleaning accessory that includes a supporting mechanism for supporting the bristle portion of a paint brush entirely below the surface of a volume of a cleaning solvent within a cleaning solvent container while ensuring the tip ends of the bristle portion of the bristle portion are suspended above the bottom surface of the cleaning solvent container.

1 Claim, 3 Drawing Sheets

PAINT BRUSH CLEANING ACCESSORY

TECHNICAL FIELD

The present invention relates to painting accessories and more particularly to a paint brush cleaning accessory that includes a support plate having a number of brush handle passage openings formed therethrough, a spring guide insert connected to a top side of the support plate such that the exterior perimeter edge thereof is adjacent to each of the brush handle passage openings, a paint brush support plate connected to a top of the spring guide insert and having a number of inward curving brush handle receiving notches equal to the number of brush handle passage openings, one brush handle receiving notch being positioned partially above one of the brush handle passage openings, and a handle retaining spring positioned around the exterior perimeter edge of the spring guide insert and having the two spring ends thereof attached together to form a closed loop; the brush handle retaining spring being sufficiently strong to retain a handle of a paintbrush pushed through a brush handle passage opening of the support plate and between the a handle retaining spring positioned around the exterior perimeter edge of the spring guide insert. The paint brush cleaning accessory may optionally be provided with a hanging support structure in supporting connection with the support plate; a compressional support/attachment structure in connection with a bottom side of the support plate, such as two or more can insert snaps extending from the bottom surface of the support plate; or both a hanging support structure and a compressional support/attachment structure.

BACKGROUND ART

Most painters use expensive paint brushes in order to achieve a better paint job as well as to make painting easier. Because these paint brushes are expensive, it would be a benefit to have a paint brush cleaning accessory that included a supporting mechanism for supporting the bristle portion of a paint brush entirely below the surface of a volume of cleaning solvent contained within a cleaning solvent container while ensuring the tip ends of the bristle portion are suspended above the bottom surface of the cleaning solvent container.

GENERAL SUMMARY DISCUSSION OF INVENTION

It is thus an object of the invention to provide a paint brush cleaning accessory that includes a support plate having a number of brush handle passage openings formed therethrough, a spring guide insert connected to a top side of the support plate such that the exterior perimeter edge thereof is adjacent to each of the brush handle passage openings, a paint brush support plate connected to a top of the spring guide insert and having a number of inward curving brush handle receiving notches equal to the number of brush handle passage openings, one brush handle receiving notch being positioned partially above one of the brush handle passage openings, and a handle retaining spring positioned around the exterior perimeter edge of the spring guide insert and having the two spring ends thereof attached together to form a closed loop; the brush handle retaining spring being sufficiently strong to retain a handle of a paintbrush pushed through a brush handle passage opening of the support plate and between the a handle retaining spring positioned around the exterior perimeter edge of the spring guide insert. The paint brush cleaning accessory may optionally be provided with a hanging support structure in supporting connection with the support plate; a compressional support/attachment structure in connection with a bottom side of the support plate, such as two or more can insert snaps extending from the bottom surface of the support plate; or both a hanging support structure and a compressional support/attachment structure.

Accordingly, a paint brush cleaning accessory is provided. The a paint brush cleaning accessory includes a support plate having a number of brush handle passage openings formed therethrough, a spring guide insert connected to a top side of the support plate such that the exterior perimeter edge thereof is adjacent to each of the brush handle passage openings, a paint brush support plate connected to a top of the spring guide insert and having a number of inward curving brush handle receiving notches equal to the number of brush handle passage openings, one brush handle receiving notch being positioned partially above one of the brush handle passage openings, and a handle retaining spring positioned around the exterior perimeter edge of the spring guide insert and having the two spring ends thereof attached together to form a closed loop; the brush handle retaining spring being sufficiently strong to retain a handle of a paintbrush pushed through a brush handle passage opening of the support plate and between the a handle retaining spring positioned around the exterior perimeter edge of the spring guide insert. The paint brush cleaning accessory may optionally be provided with a hanging support structure in supporting connection with the support plate; a compressional support/attachment structure in connection with a bottom side of the support plate, such as two or more can insert snaps extending from the bottom surface of the support plate; or both a hanging support structure and a compressional support/attachment structure.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
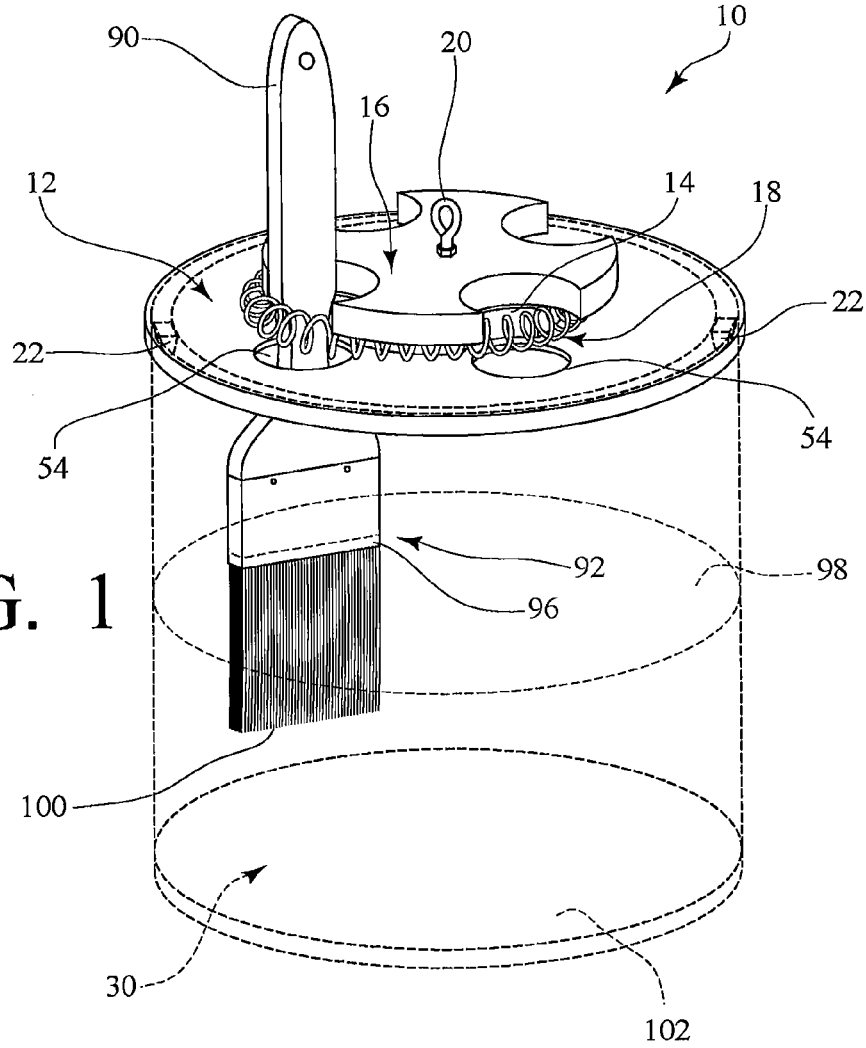
FIG. 1 is a perspective view of an exemplary embodiment of the paint brush cleaning accessory of the present invention along with a representative paint brush and a representative solvent container partially filled with a paint solvent liquid; the bristle portion being totally immersed in the paint solvent liquid without the bristle tips touching the inside bottom of the solvent container.
Figure 2:
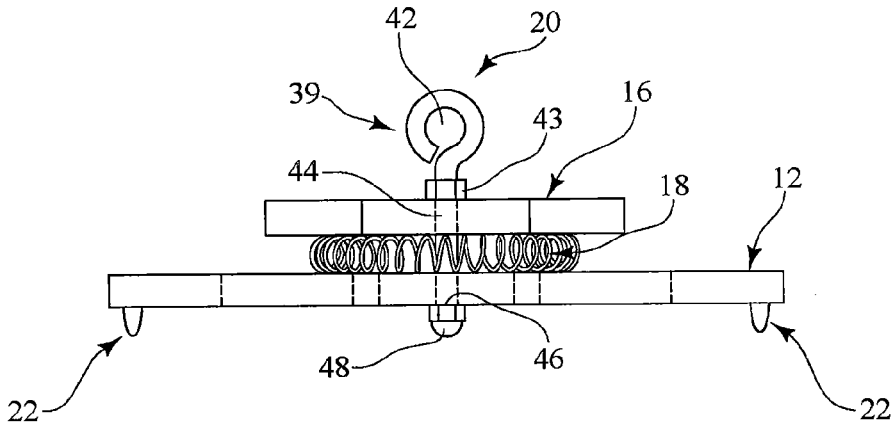
FIG. 2 is a side plan view of the paint brush cleaning accessory of FIG. 1.
Figure 3:
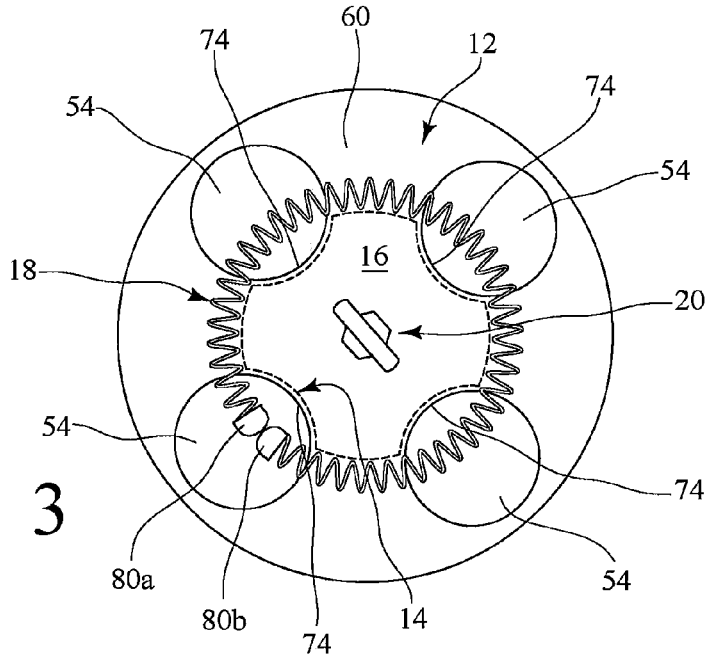
FIG. 3 is a top plan view of the paint brush cleaning accessory of FIG. 1.
Figure 4:
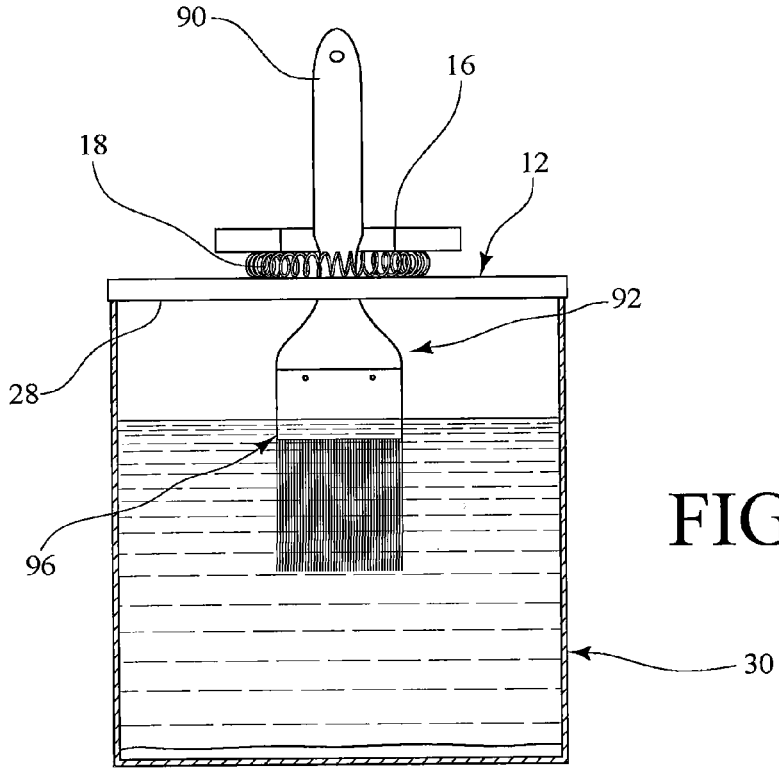
FIG. 4 is a side plan view of the paint brush cleaning accessory, a representative paint brush and a representative solvent container partially filled with a paint solvent liquid; the bristle portion being totally immersed in the paint solvent liquid without the bristle tips touching the inside bottom of the solvent container.
Figure 5:
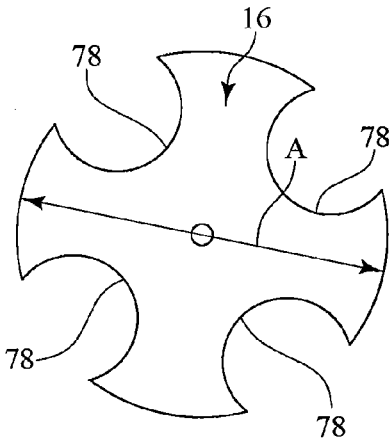
FIG. 5 is a top plan view of the paint brush support plate of the paint brush cleaning accessory of FIG. 1 in isolation.
Figure 6:
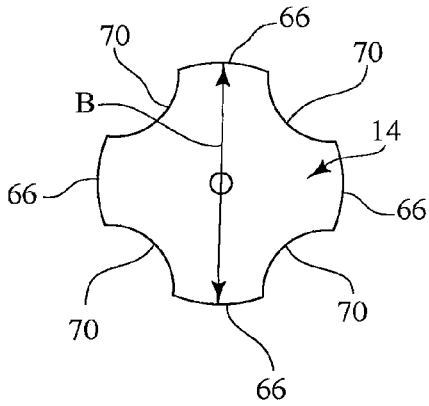
FIG. 6 is a top plan view of the spring guide insert of the paint brush cleaning accessory of FIG. 1 in isolation.
Figure 7:
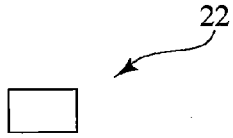
FIG. 7 is a side plan view of one of the two identical can insert snaps of the paint brush cleaning accessory of FIG. 1 in isolation.
Figure 8:
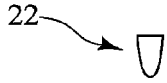
FIG. 8 is an end plan view of one of the two identical can insert snaps of the paint brush cleaning accessory of FIG. 1 in isolation.

FIGS. 1-8 show various aspects of an exemplary embodiment of the paint brush cleaning accessory of the present invention generally designated 10. Paint brush cleaning accessory 10 includes a support plate, generally designated 12; a spring guide insert, generally designated 14; a paint brush support plate, generally designated 16; a handle retaining spring, generally designated 18; a hanging support structure, generally designated 20; and two identical compressional support/attachment structures, each generally designated 22.

Support plate 12 is constructed from circular piece of a paint solvent immune material, such as aluminum or acrylic sheeting, and has a bottom side 28 having two can insert snaps 22 extending from the bottom outer edge thereof that are adapted to snap into the channel provided around the top opening of a paint can 30 that may be used as a paint solvent container.

Hanging support structure 20 is an I-bolt, generally designated 39, having an eye portion 42 and an elongated threaded rod portion 44 that has a regular hex nut 43 threaded thereon up to the eye portion 42 and is positioned through eye-bolt holes formed through the centers of the support plate 12, the spring guide insert 14 and the paint brush support plate 16. The bottom end 46 of the threaded rod portion 44 has an acorn lock nut 48 threaded thereon to hold the support plate 12, the spring guide insert 14 and the paint brush support plate 16 together and allow the eye portion 42 to be used as a handle or hanging ring.

Support plate 12 has four brush handle passage openings 54 formed therethrough and spaced around the center thereof. Spring guide insert 14 has a bottom side connected to a top side 60 of support plate 12, a top side connected to the bottom side of paint brush support plate 16, and an exterior perimeter edge 66 that has four insert notches 70 spaced around the perimeter thereof that are spaced such that each notch 70 corresponds with an interior perimeter edge section 74 of one of the four brush handle passage openings 54.

Paint brush support plate 16 has four inward curving brush handle receiving notches 78 that are each positioned above one of the four brush handle passage openings 54. The diameter "A" of paint brush support plate 16 is greater than the diameter "B" of spring guide insert 14.

Handle retaining spring 18 is a 316 stainless alloy tension spring with an outside diameter of about 3/16" and a spring end connecting hook 80*a*, 80*b* at each end. The length of handle retaining spring 18 is selected such that handle retaining spring 18 is slightly in tension when handle retaining spring 18 is looped entirely around spring guide insert 14 and spring end connecting hooks 80*a*, 80*b* secured to each other. The spring constant of handle retaining spring 18 is selected such that when a handle 90 of a paintbrush, generally designated 92, is pushed through one of the four brush handle passage openings 54 of support plate 12 and between handle retaining spring 18 and the exterior perimeter edge of the spring guide insert 14 forming notch 70, handle retaining spring exerts sufficient force against handle 90 to hold the brush portion 96 suspended within a volume of paint solvent 98 such that the bristles are entirely covered by paint solvent 98, and the bristle tips 100 are maintained above the bottom surface 102 of paint solvent container 30.

It can be seen from the preceding description that a paint brush cleaning accessory has been provided.

It is noted that the embodiment of the paint brush cleaning accessory described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A paint brush cleaning lid comprising:

a support plate having a number of brush handle passage openings formed therethrough, a spring guide insert connected to a top side of the support plate such that the exterior perimeter edge thereof is adjacent to each of the brush handle passage openings, a paint brush support plate connected to a top of the spring guide insert and having a number of inward curving brush handle receiving notches equal to the number of brush handle passage openings, one brush handle receiving notch being positioned partially above one of the brush handle passage openings, and a handle retaining spring positioned around the exterior perimeter edge of the spring guide insert and having the two spring ends thereof attached together to form a closed loop; the brush handle retaining spring being sufficiently strong to retain a handle of a paintbrush pushed through a brush handle passage opening of the support plate and located between the handle retaining spring positioned around the exterior perimeter edge of the spring guide insert;

the support plate having multiple can insert snaps extending from a bottom surface thereof that are positioned to seat into a channel formed about the top opening of a paint can.

* * * * *